US009485575B2

(12) United States Patent
Marguery et al.

(10) Patent No.: US 9,485,575 B2
(45) Date of Patent: Nov. 1, 2016

(54) PRE-FILTERING FOR LOUDSPEAKERS PROTECTION

(75) Inventors: Philippe Marguery, Poisat (FR); Angelo Nagari, Grenoble (FR); Philippe Sirito-Olivier, Saint-Egreve (FR)

(73) Assignee: ST-Ericsson SA, Plan-les-Ouates (CH)

( * ) Notice: Subject to any disclaimer, the term of this patent is extended or adjusted under 35 U.S.C. 154(b) by 327 days.

(21) Appl. No.: 14/129,690

(22) PCT Filed: Jun. 28, 2012

(86) PCT No.: PCT/EP2012/062619

§ 371 (c)(1),
(2), (4) Date: Jan. 20, 2014

(87) PCT Pub. No.: WO2013/001028

PCT Pub. Date: Jan. 3, 2013

(65) Prior Publication Data

US 2014/0146971 A1 May 29, 2014

Related U.S. Application Data

(60) Provisional application No. 61/515,163, filed on Aug. 4, 2011.

(30) Foreign Application Priority Data

Jun. 29, 2011 (EP) ..... 11305831

(51) Int. Cl.
*H04R 3/00* (2006.01)

(52) U.S. Cl.
CPC ..... *H04R 3/007* (2013.01); *H04R 3/002* (2013.01)

(58) Field of Classification Search
None
See application file for complete search history.

(56) References Cited

U.S. PATENT DOCUMENTS

| | | | | |
|---|---|---|---|---|
| 4,113,983 | A | 9/1978 | Steel | |
| 4,327,250 | A | 4/1982 | von Recklinghausen | |
| 5,481,617 | A * | 1/1996 | Bjerre | H03G 5/165 381/107 |
| 5,577,126 | A * | 11/1996 | Klippel | H04R 3/002 330/129 |
| 7,372,966 | B2 * | 5/2008 | Bright | H04R 3/007 381/55 |
| 2004/0228496 | A1 * | 11/2004 | Lin | H04R 3/00 381/111 |
| 2005/0226439 | A1 | 10/2005 | Ludeman | |
| 2008/0030277 | A1 | 2/2008 | Boughton, Jr. | |
| 2008/0212818 | A1 | 9/2008 | DelPapa et al. | |
| 2012/0300949 | A1 * | 11/2012 | Rauhala | H04R 29/001 381/55 |

FOREIGN PATENT DOCUMENTS

| | | | |
|---|---|---|---|
| WO | 0103466 | A2 | 1/2001 |
| WO | 2007073341 | A2 | 6/2007 |

OTHER PUBLICATIONS

Wikipedia, "Wilson current mirror." pp. 1-3. Jan. 31, 2011.*

* cited by examiner

*Primary Examiner* — Curtis Kuntz
*Assistant Examiner* — Qin Zhu
(74) *Attorney, Agent, or Firm* — Coats & Bennett, PLLC

(57) ABSTRACT

The present invention relates to a method of protecting an inductive loudspeaker. The method comprises filtering the audio stream by applying a compensation filter to the audio stream, sending the filtered audio stream to the inductive loudspeaker, computing an estimation of a frequency response of the inductive loudspeaker and updating the compensation filter so as to attenuate a frequency corresponding to a resonant frequency in the estimated frequency response of the inductive loudspeaker.

18 Claims, 10 Drawing Sheets

PRE-FILTERING FOR LOUDSPEAKERS PROTECTION

TECHNICAL FIELD

The present invention generally relates to protections of loudspeakers, especially in electro-dynamic applications for avoiding damages and destructions of the mechanical parts of the loudspeakers.

BACKGROUND

The approaches described in this section could be pursued, but are not necessarily approaches that have been previously conceived or pursued. Therefore, unless otherwise indicated herein, the approaches described in this section are not prior art to the claims in this application and are not admitted to be prior art by inclusion in this section. Furthermore, all embodiments are not necessarily intended to solve all or even any of the problems brought forward in this section.

Inductive loudspeakers often include a coil arranged around a magnetic core which is mechanically coupled with a membrane. Sound is produced by membrane displacements caused by magnetic core motion through inductive coupling to the coil which is controlled by an electrical signal oscillating at given frequencies.

Loudspeakers converting thus an electrical signal into an acoustic signal can be endangered to malfunction or permanent destruction when they are solicited beyond their acceptable limits. If the electrical signal level is too high at specific frequencies, membrane displacement can be such that damage can occur, either by self-heating, mechanical constraint, or by demagnetization of the magnetic core. For instance, the coil of a loudspeaker can hit the mechanical structures of the device or the mobile membrane can be torn if the constraints are too high.

In particular, these issues are very complex to solve for small inductive loudspeakers such as those in mobile devices such as mobiles or smart phones. Dimensions of those loudspeakers impact the heat dissipation and mechanical constraints.

Moreover, being a mechanical oscillator, the loudspeaker may have a resonant frequency which amplifies the amplitude of the control signal at said frequency.

In order to protect inductive loudspeakers against damages due to self-heating and excessive mechanical displacement of the membrane, non adaptive systems have been developed based on an "a priori" prediction of the frequency response of the inductive loudspeakers.

U.S. Pat. Nos. 4,113,983, 4,327,250 and 5,481,617 propose to use variable cut-off frequency filters driven by a membrane displacement predictor. The filter parameters are set according to a prediction of the loudspeaker membrane displacement response over frequency. Parameters are predicted based on a static model of the loudspeaker which is defined once in the life of the product.

U.S. Pat. No. 5,577,126 proposes to use attenuators. The output of the displacement predictor is fed-back into the input signal, according to a feedback parameter computed by a threshold calculator, this parameter being calculated once in the life of the product.

International patent application No. WO 01003466 proposes to use multi-frequency band dynamic range controllers. The input signal is divided into N frequency bands by a bank of band-pass filters. The energy of each frequency band is controlled by a variable gain before being summed together and input to the loudspeaker. A processor monitors the signal level in each frequency band and acts on parameters of each of the variable gain subsystems in order to limit the membrane displacement based on pre-calculated frequency response.

Nevertheless, in case of variations of the loudspeaker transfer function over time, these solutions could not be able to adapt their parameters, as these parameters are calculated once in the life of the product. These variations may result from several factors: temperature, atmospheric pressure, ageing, humidity variations, etc. In contrast, an "a priori" based compensation can not track the real time loudspeaker response, and a compensation filter can not be able to avoid loudspeaker damages in certain conditions.

SUMMARY

A first aspect of the present invention thus relates to a method of protecting an inductive loudspeaker (108) arranged to consume a current of a given value during reproduction of an audio stream.

The method comprises:

a/ filtering (801) a first part of the audio stream by applying a compensation filter to said first part of the audio stream;

b/ inputting the filtered first part (OUT) of the audio stream to the inductive loudspeaker;

c/ computing (802) at least a first estimation of a frequency response of the inductive loudspeaker based at least on:

the filtered first part (OUT) of the audio stream; and the value of the current consumed (RET) by the inductive loudspeaker during reproduction of the filtered first part of the audio stream;

d/ updating (805) characteristics of the compensation filter so as to attenuate a resonant frequency in the first estimated frequency response of the inductive loudspeaker.

A part of an audio stream is a temporal subset of the audio stream. For instance, this subset can be an extract of 100 milliseconds of the audio stream. In one other embodiment, the subset can be, for instance, an extract of 23 ms (corresponding to 1024 samples at 44.1 kHz): this can relax memory size keeping low constraints on real time processing To "apply a compensation filter to the part of the audio stream" generally means that the frequencies of the part of the audio stream are filtered according to the compensation filter.

When it is stated that the filtered part of the audio stream is input to the inductive loudspeaker, it is to be construed that the inputting can be direct or indirect to the inductive loudspeaker. For instance, and as described in FIG. 1, the filtered part can transit via a "digital to analog converter" and/or an amplifier before the inductive loudspeaker.

To "attenuate a resonant frequency in the estimated frequency response" means that the frequencies near the resonant frequency (or equal to this resonant frequency) is attenuated. For instance, the logarithm module of the filter can be substantially below "zero" for frequencies near the resonant frequency.

To "update characteristics of the compensation filter" consists, for instance, in replacing the first compensation filter (respectively its parameters) with a second compensation filter (respectively its parameters) or in merging the first compensation filter with information of the second compensation filter (for instance, result of this modification can be the average filter computed with the first and second compensation filter).

Hence, the updating of the compensation filter enables a feedback loop which can dynamically remove the resonant frequency of a loudspeaker. It ensures that the compensation filter evolves during time and life time of the loudspeaker (for instance due to heat or humidity) and avoiding any loudspeakers damages or deteriorations.

For instance, the updated characteristics of the compensation filter can define a band-stop filter adapted to attenuate the resonant frequency in the first estimated frequency response of the inductive loudspeaker.

Thus, the implementation (circuit implementation or programming implementation) can be simple as this type of filter is common in electronics and filter domain.

According to another embodiment, steps a/ to d/ can be repeated for a second part of the audio stream.

For instance, this second part of the audio stream is a temporal subset of the audio stream following the above mentioned part (in step a/). Thus, the method can be reapplied, in a loop, for all subsets of the audio stream.

Moreover, the compensation filter evolves while the reproducing of the audio stream and ensures a dynamic protection all over the reproduction of the audio.

According to another embodiment, compensation filter is updated at step d/ only if a second estimated response of the loudspeaker is lower than a threshold. The second estimated response can be, for instance, computed by applying the estimation of a frequency response of the inductive loudspeaker to a third part of the audio stream.

The threshold can be adjusted for a given loudspeaker. This threshold value can be fixed for a given type of loudspeaker and is not to be changed from one loudspeaker sample to another. It can be fixed before production on some phone during the tuning procedure.

The third part of the audio stream can be advantageously the second part mentioned above.

Consecutively, the compensation filter can be updated only if needed, i.e. only if the compensation performed by the previous compensation filter is not sufficient. In particular, if the second estimated response is lower than the threshold, it can mean that the frequency response of the loudspeaker has not changed significantly and that there is no need to change the second compensation filter to a new one. The threshold can also avoid equalization if spectral density of the signal is low and thus if there is no risk to damage the loudspeaker. This can offer optimum audio rendering avoiding cutting some frequencies of the audio signal if it is not needed.

According to another embodiment, the value of the current consumed by the inductive loudspeaker during reproduction of the filtered part of the audio stream can be sensed by electronic circuit coupled to the inductive loudspeaker through a current mirror circuit.

Current mirror circuit is a circuit designed to copy a current through one active device. For instance, such circuit can be a "Wilson mirror" made with simple transistors.

Thus, there is no need to use an element in series with the loudspeaker (sense resistor) which can decrease the maximum electrical power expected in the load and thus the maximum sound pressure level.

A second aspect relates to a processing device, connected with a mixing signal unit comprising an inductive loudspeaker. The processing device includes:

- an input interface to receive a part of an audio stream;
- an input interface to receive a value of a current consumed by the inductive loudspeaker;
- an output interface to send a filtered part of an audio stream.

In this embodiment, the processing device is configured to:

a/ filter (801) a first part of the audio stream by applying a compensation filter to said first part of the audio stream;

b/ input the filtered first part (OUT) of the audio stream to the inductive loudspeaker;

c/ compute (802) at least a first estimation of a frequency response of the inductive loudspeaker based at least on:

- the filtered first part (OUT) of the audio stream; and
- the value of the current consumed (RET) by the inductive loudspeaker during reproduction of the filtered first part of the audio stream;

d/ update (805) characteristics of the compensation filter so as to attenuate a resonant frequency in the first estimated frequency response of the inductive loudspeaker.

A third aspect relates to an electronic device comprising a processing device as mentioned above. An electronic apparatus can be for instance a mobile phone, a smart phone, a PDA (for "Personal Digital Assistant"), a touch pad, or a personal stereo.

A fourth aspect relates to a computer program product comprising a computer readable medium, having thereon a computer program comprising program instructions. The computer program is loadable into a data-processing unit and adapted to cause the data-processing unit to carry out the method described above when the computer program is run by the data-processing unit.

BRIEF DESCRIPTION OF THE DRAWINGS

The present invention is illustrated by way of example, and not by way of limitation, in the figures of the accompanying drawings, in which like reference numerals refer to similar elements and in which.

DESCRIPTION OF PREFERRED EMBODIMENTS

Figure 2:
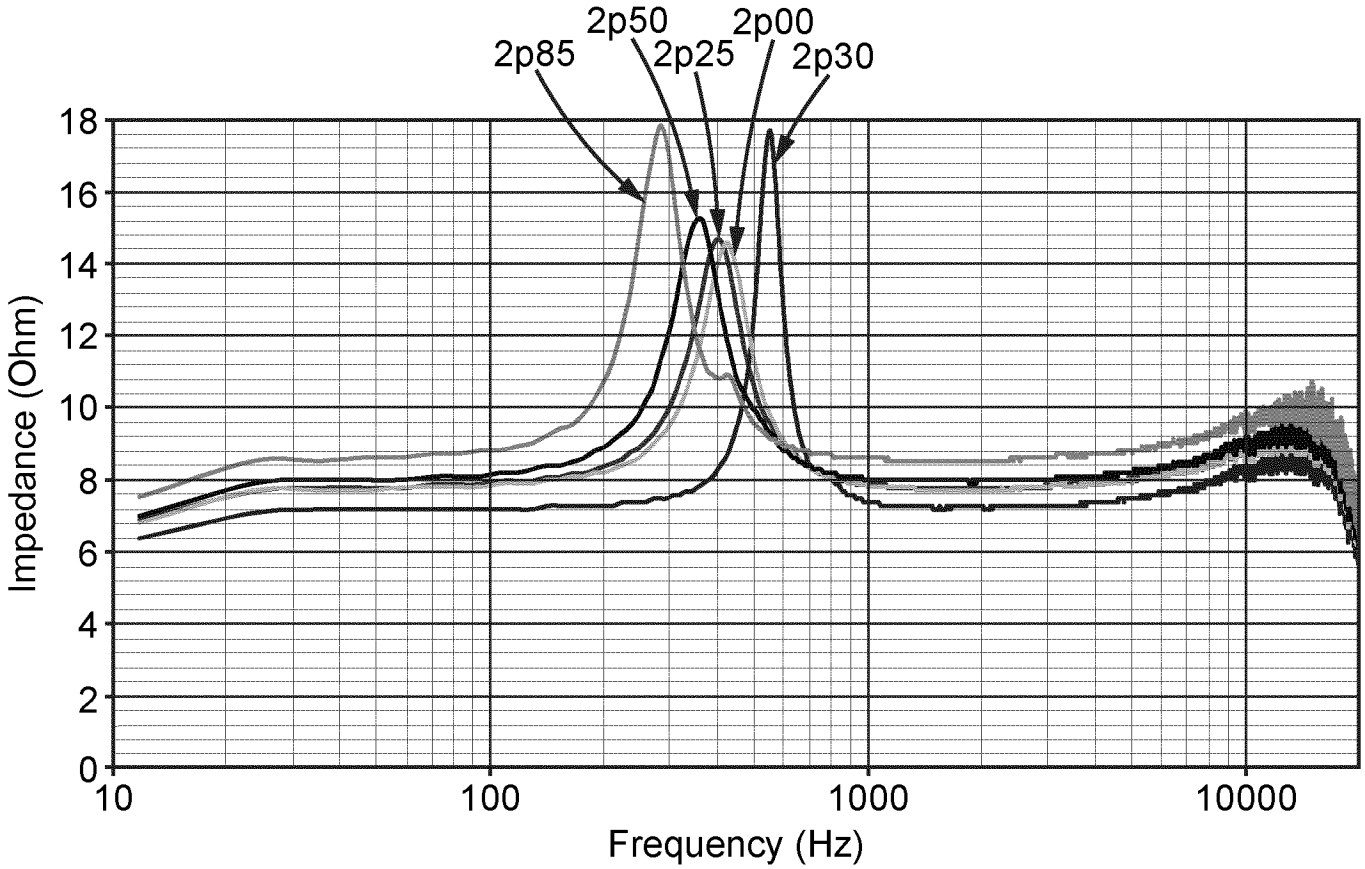
FIG. 2 shows chart examples of different frequency responses of an inductive loudspeaker upon temperature variations.

In order to illustrate variations of the impedance frequency responses due to temperature, multiple impedance frequency responses are presented in FIG. 2:

- Chart 2p85 represents the impedance frequency response of an inductive loudspeaker for a temperature of 85° C.;
- Chart 2p50 represents the impedance frequency response of the same inductive loudspeaker for a temperature of 50° C.;
- Chart 2p25 represents the impedance frequency response of the same inductive loudspeaker for a temperature of 25° C.;
- Chart 2p00 represents the impedance frequency response of the same inductive loudspeaker for a temperature of 00° C.;
- Chart 2m30 represents the impedance frequency response of the same inductive loudspeaker for a temperature of −30° C.

Figure 1:
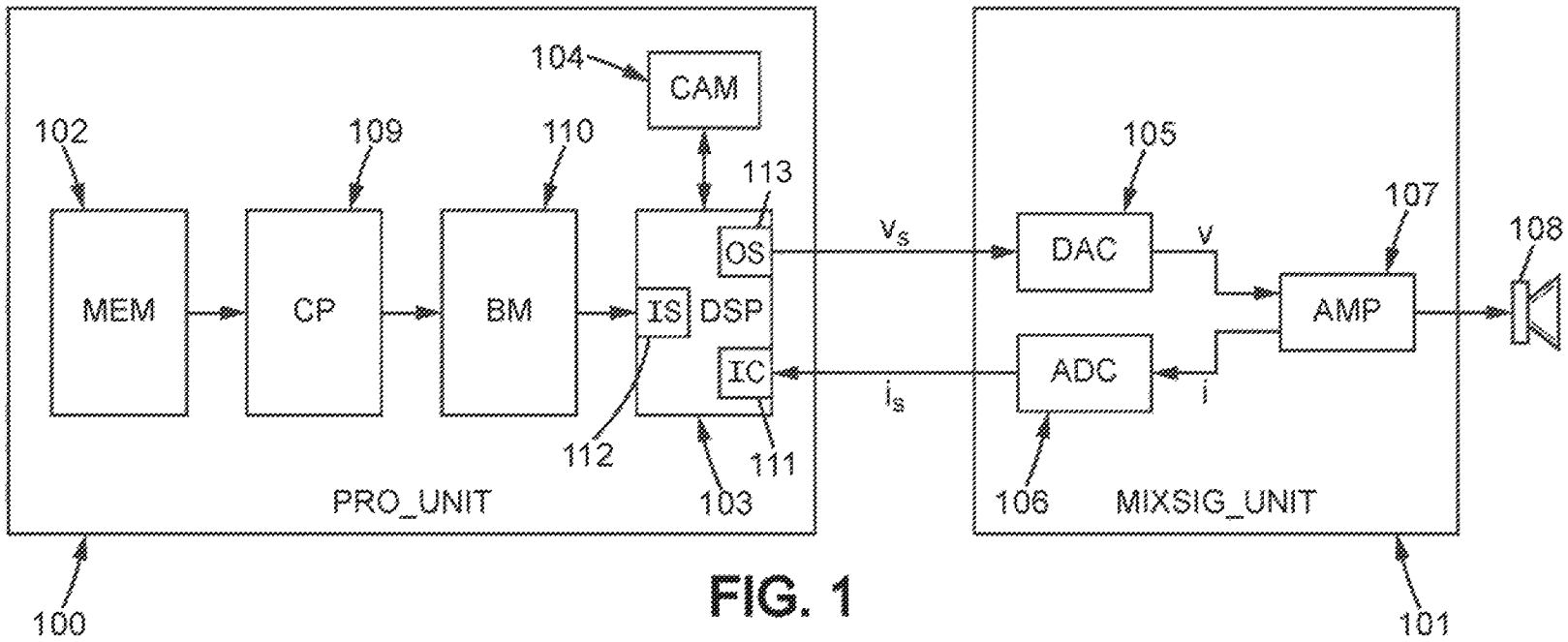
FIG. 1 is a possible data flow for filtering an audio stream in a processing unit and in a mixing signal unit.

FIG. 1 presents a control device for an inductive loudspeaker in order to avoid damages in a possible embodiment of the invention.

A processing unit 100 includes:

- a non-volatile memory 102,
- a cache memory 104,
- a buffer memory 110,
- a core processor 109, and
- a digital signal processing 103 or DSP.

When it is needed to reproduce a song or an audio file, the core processor 109 retrieves a compressed music file stored on the non-volatile memory 102 and performs the needed transcoding from compressed format to uncompressed one. After transcoding, the data is sent to the DSP 103 through a buffer memory 110 able to store some hundreds of milliseconds of uncompressed data.

The DSP 103 is able to perform digital filtering, Fourier transforms (FFT for instance) and Power Spectral Density algorithms (or PSD algorithms).

After data processing, the DSP 103 sends the data to the mixed signal block 101. This data (being in a digital format) is then converted in analog format by a DAC 105 (for "Digital to Analog Converter") before being amplified by an amplifier 107 and being transmitted to the inductive loudspeaker 108.

It has to be noted that, in the case of an inductive loudspeaker, the electrical impedance frequency response of the loudspeaker is very similar to the mechanical/acoustic impedance frequency response. These two impedance frequency response are coupled. Consecutively, by monitoring the current flowing inside the loudspeaker, it is possible to determine the acoustic impedance frequency response of the loudspeaker (and vice and versa). The processing unit 100 computes the membrane displacement frequency response through the electrical impedance frequency response.

It is to be noted that the monitoring of the current flowing inside the loudspeaker can be performed without using a sensor in series with the loudspeaker. Indeed, a sense resistor in series can decrease the maximum electrical power expected in the load and thus the maximum sound pressure level. This can be a weakness for mobile phone application since maximum acoustic loudness is a target for mobile phone manufacturers. Advantageously, the monitoring can be performed with a copy of the current with transistors laying (also known as "current mirrors").

The information drawn from this monitoring/sensing is sent to an ADC 106 (for "Analog to Digital Converter) that converts the analog measurement to a digital format to be sent back to the DSP 103 in the processing unit 100.

As the processing is performed on part of the stream (for instance, about ten milliseconds), there is no constraint on ADC 106 and DAC 105 latency, time realignment can be done before computation.

When the DSP 103 receives the measurement of the current, the DSP 103 processes it in regards with the previous sent signal(s) in order to determine the impedance frequency response of the loudspeaker.

This is achievable because both the instantaneous current and voltage across the loudspeaker are known, for instance:

- instantaneous current is known by measurement performed onto the amplifier 107,
- instantaneous voltage is known by converting the input signal in volt.

The electrical impedance frequency response is computed inside the audio band (roughly from 20 Hz to 20 kHz). For instance, about ten millisecond of signal are analyzed, allowing having an accurate estimation of the impedance frequency response.

The electrical impedance transfer response LS(f) is computed by the ratio between the "voltage power spectral density" $P_{v,v}(f)$ over the "voltage/current cross power spectral density"

$$P_{i,v}(f), \text{ i.e. } LS(f) = \frac{P_{v,v}(f)}{P_{i,v}(f)}.$$

The "voltage power spectral density" (often called "the spectrum of the power of a signal") can be defined as $$P_{v,v}(f) = \frac{1}{F_s N}\left(\left|\sum_{n=1}^{N} v_n e^{-j\left(2\pi\frac{f}{F_s}\right)n}\right|\right)^2$$

for a signal $v=[v_1 \ldots v_N]$ of length N sampled at a frequency $F_S$.

The "voltage/current cross power spectral density" is the cross-power spectral density between i and v (i.e. the Fourier transform of the cross-correlation between the voltage and the current across the loudspeaker) and can be defined as $$P_{i,v}(f) = \frac{1}{F_s N}\left(\sum_{n=1}^{N} R(n)_{i,v} e^{-j\left(2\pi\frac{f}{F_s}\right)n}\right) \text{ with } R(m)_{i,v} = \sum_{p=1}^{N} i_{p+m}\overline{v_p}$$

for a signal $v=[v_1 \ldots v_N]$ of length N sampled at a frequency $F_s$ and a signal $i=[i_1 \ldots i_N]$ of length N sampled at a frequency $F_s$ and where $\overline{v_n}$ is the complex conjugate of $v_n$.

Once the electrical impedance transfer response LS(f) determined (discrete function), the DSP 103 is able to compute the modelled inductive loudspeaker impedance (continuous function). This modelled impedance is an approximation of the real electrical impedance transfer response and can be, for instance, a second order underdamped transfer function whose expression is, in the "s" domain, $$LS_m(s) = K_{LS}\frac{1}{(\omega_{LS})^2 + \frac{s\omega_{LS}}{Q_{LS}} + s^2} \text{ with } Q_{LS} > \frac{1}{\sqrt{2}}$$

(because it is anticipated that the modelled impedance function has a resonant frequency). Even if the real impedance function LS(f) is not an under-damped transfer function, this approximation has no impact on the result of the present method.

Figure 9:
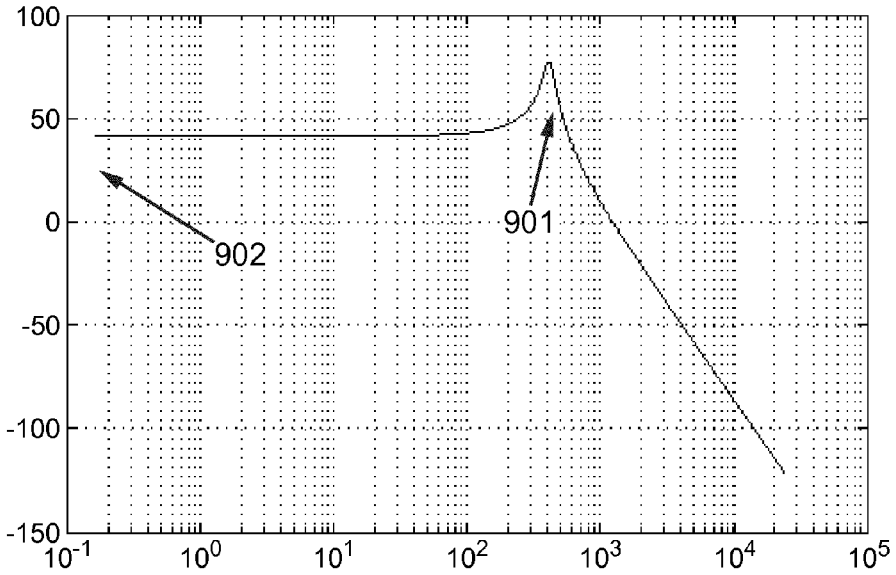
FIG. 9 presents a module of a possible second order under-damped filter.

The coefficient $\omega_{LS}$, $Q_{LS}$, and $K_{LS}$ can be determined from the electrical impedance transfer response LS(f). $K_{LS}$ is the value of LS(f) when f is close to 0 Hz (see point 902 of the FIG. 9). $\omega_{LS}$ is the frequency where LS(f) is maximal (see point 901 of the FIG. 9). $Q_{LS}$ is determined as $$Q_{LS} = \frac{|LS_m(j \cdot \omega_{LS})|}{K_{LS}}.$$

Figure 3A:
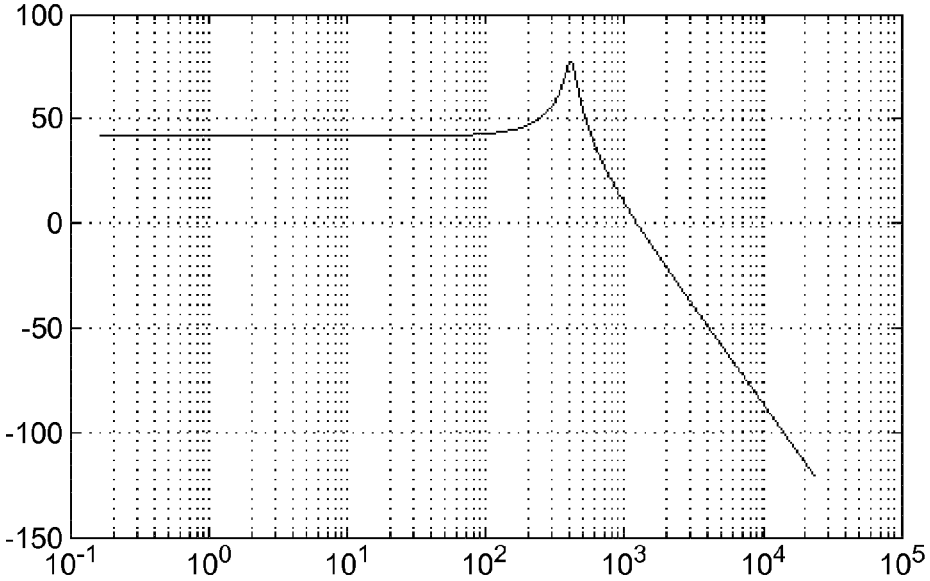
FIGS. 3*a* and 3*b* present the module and the phase of a possible modelled frequency response for an inductive loudspeaker.
Figure 3B:
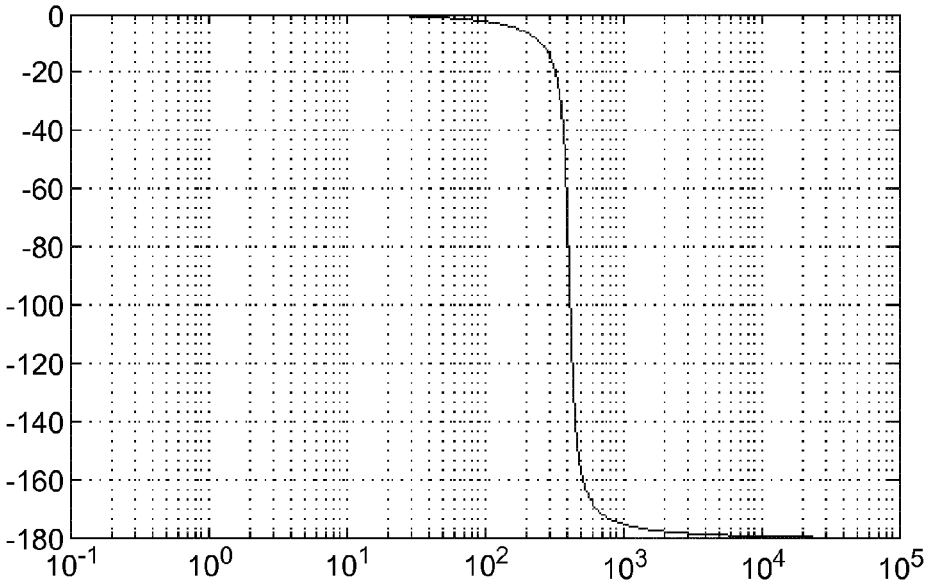

For instance, FIG. 3*a* illustrates a possible loudspeaker response module and FIG. 3*b* illustrates a possible loudspeaker response phase.

It is noted that it is also possible to model the impedance function with other transfer functions such as third or even higher order under-damped transfer function. The generalization is simple in regard of the explanation of the second order transfer function and curve fitting principles (for instance, the least squares methods, polynomial interpolations, or multiple regressions).

The modelled transfer function can also be from other types (i.e. non under-damped transfer function).

In the case of a second order impedance function, the peaking (i.e. the resonance shown on FIG. 9) can be compensated with a second order notch filter (or band-stop filter) whose transfer function is for instance:

$$H_m(s) = K_{ALP}\frac{(\omega_{LS})^2 + \frac{s\omega_{LS}}{Q_{LS}} + s^2}{(\omega_{ALP})^2 + \frac{s\omega_{ALP}}{Q_{ALP}} + s^2}.$$

It has been determined that, in order to provide a good compensation, the coefficient $\omega_{ALP}$ can be equal to $$\omega_{LS},\ K_{ALP} = 1 \text{ and } Q_{ALP} = \frac{1}{\sqrt{2}}.$$

Consecutively, the equalized transfer function is $$LS_m(s)H_m(s) = K_{LS}\frac{1}{(\omega_{LS})^2 + s\omega_{LS}\sqrt{2} + s^2}.$$

This formula represents a second order under-damped transfer function without any resonance. The transfer function $H_m(s)$ can be classically converted into frequency space and, then a transfer function H(f) can be constructed.

Figure 4A:
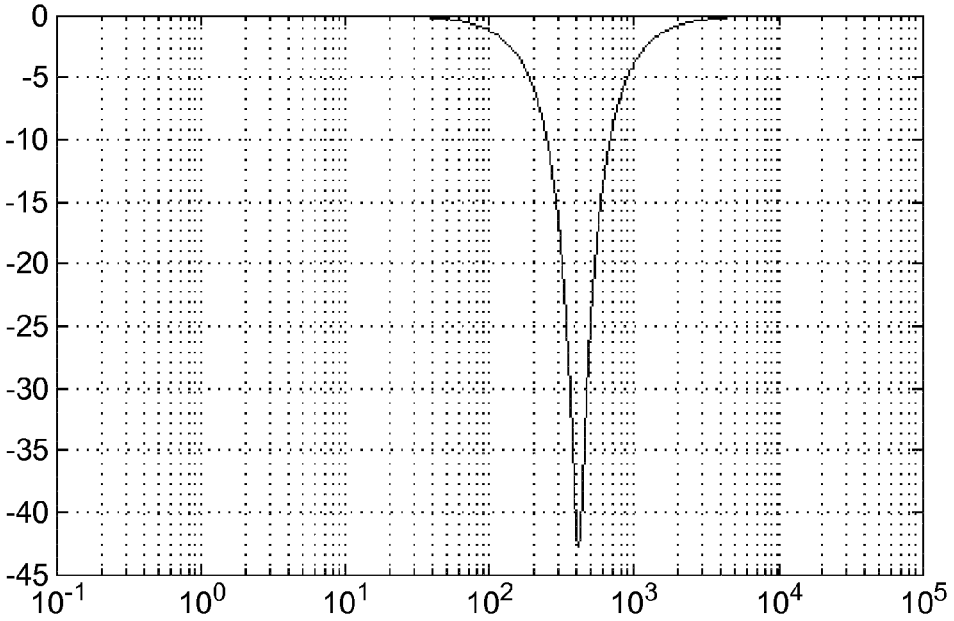
FIGS. 4*a* and 4*b* present the module and the phase of a possible "adaptive loudspeaker protection" ("ALP") filter.
Figure 4B:
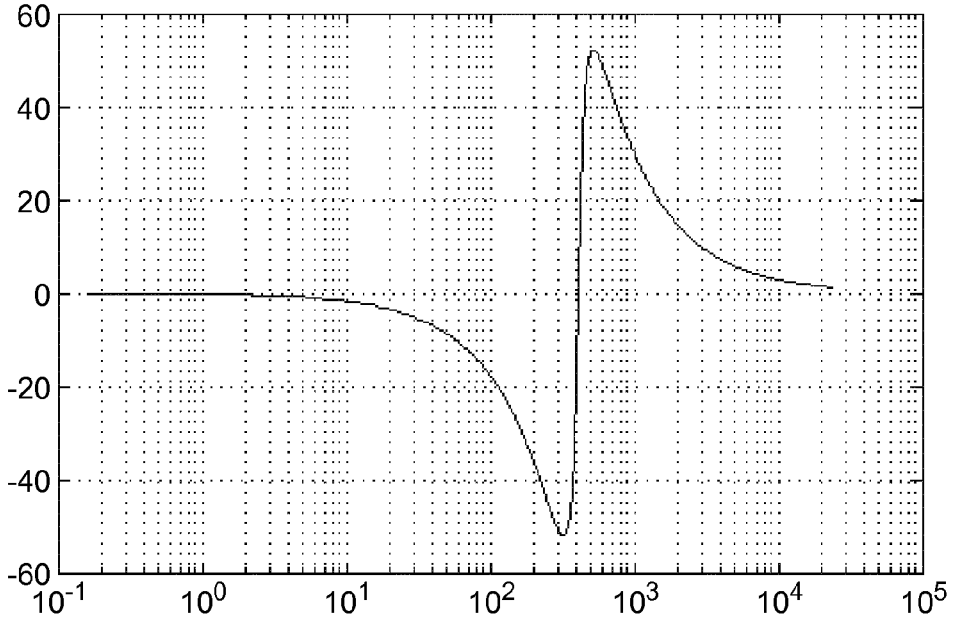

For instance, FIG. 4*a* illustrates a possible response module for $H_m(s)$ and FIG. 4*b* illustrates a possible response phase forth $H_m(s)$.

The transfer function $H_m(s)$ is named "compensation filter" or "Adaptive Loudspeaker Protection (ALP) filter" as it aims at compensating the resonance of the response function of the inductive loudspeaker.

It is noted that for implementation purposes, it is possible to execute exactly the same process in the "z" domain. For the above description, the process has been detailed with the "s" domain only but the generalization to the "z" domain is possible to the person skilled in the art.

If the DSP 103 implements an ALP (for "Adaptive Loudspeakers Protection") system, H(f)LS(f) corresponds to the loudspeaker membrane displacement frequency response when is running.

The update of the compensation filter (or its coefficients) can be done as soon as a new loudspeaker impedance frequency response is computed from a part of the audio stream.

Figure 5A:
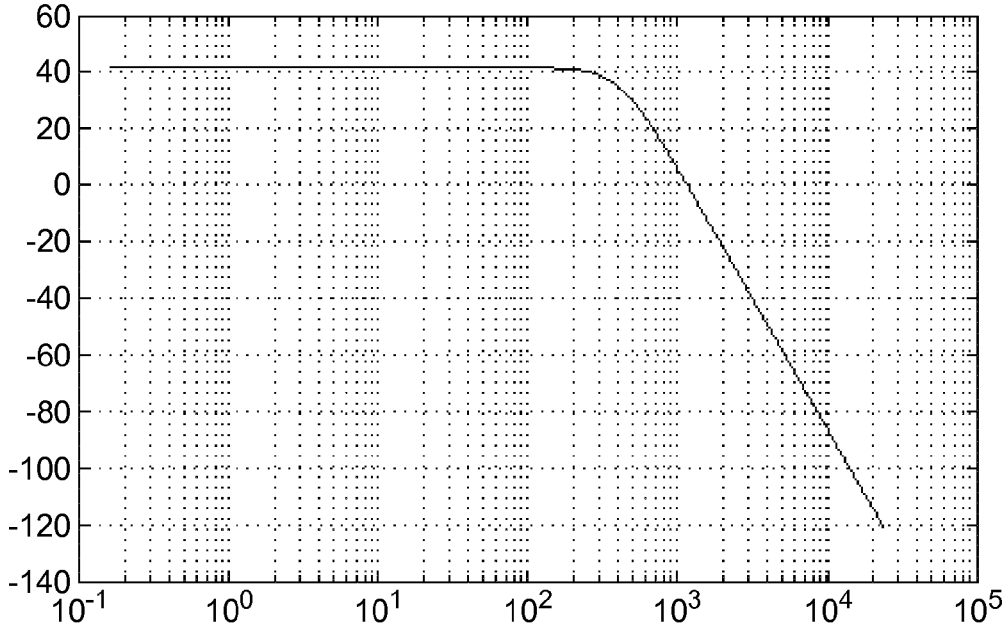
FIGS. 5*a* and 5*b* present the module and the phase of a possible modelled frequency response for an inductive loudspeaker when the ALP filter is applied to the input audio stream.
Figure 5B:
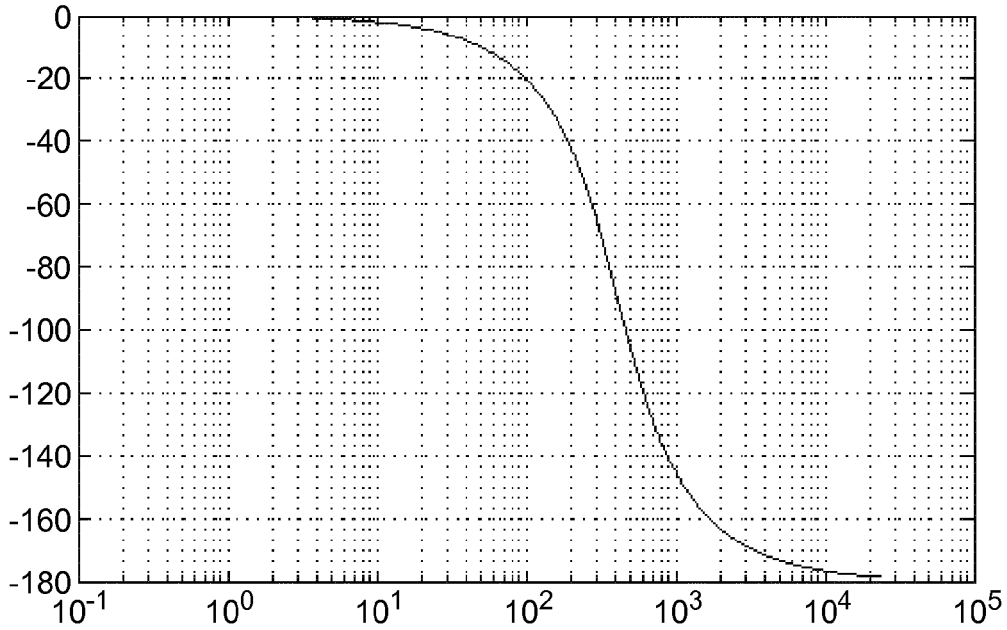

For instance, FIG. 5*a* illustrates a possible response module for the equalized loudspeaker ($LS_m(s)H_m(s)$) and FIG. 5*b* illustrates a possible response phase for the equalized loudspeaker ($LS_m(s)H_m(s)$).

Thus, membrane displacement can not induce destructive damages as the displacement can be totally anticipated and controlled. No mechanical resonance can occur.

Figure 6A:
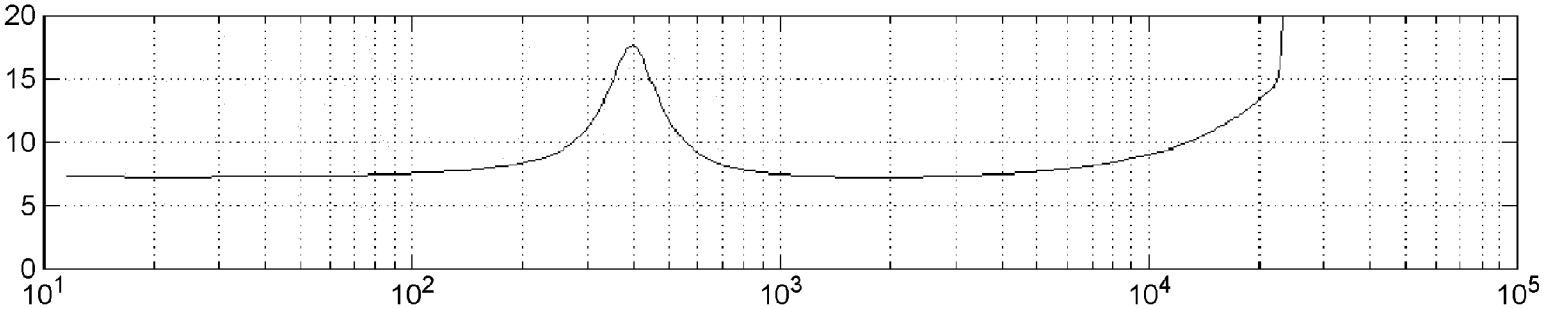
FIGS. 6*a*, 6*b* and 6*c* present respectively the module of a possible frequency response of a loudspeaker when solicited with a white noise (ideal pattern for transfer function estimation), the module of the corresponding compensation filter and the module of the loudspeaker when solicited with a white noise filtered with the compensation filter.
Figure 6B:
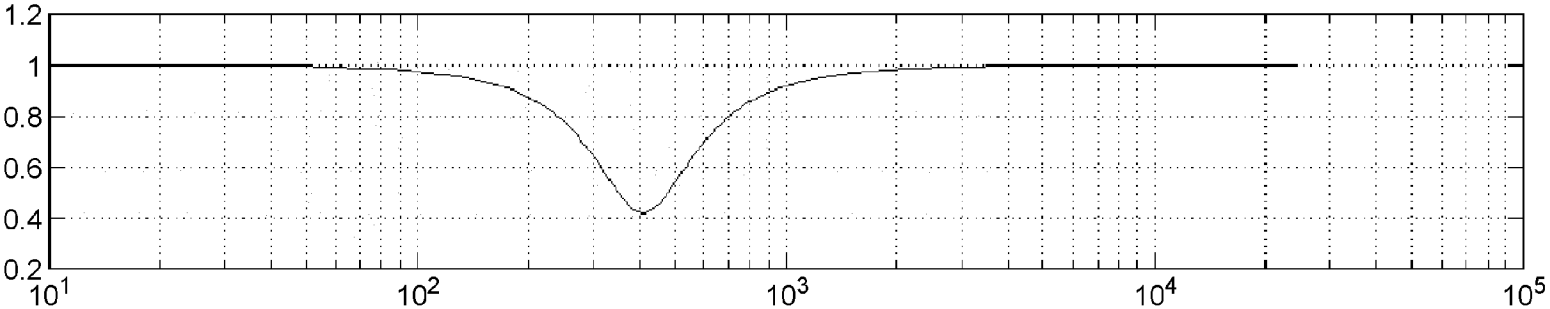
Figure 6C:
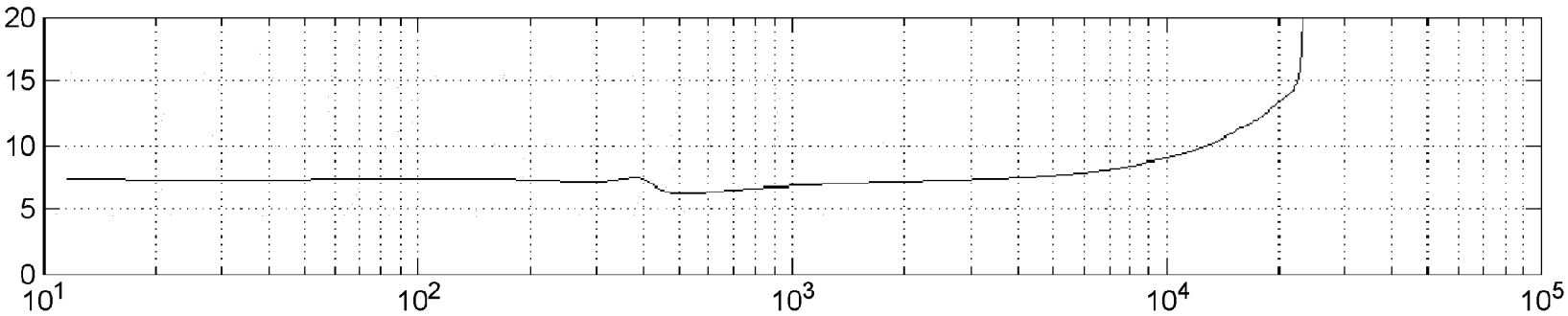

To summarize the effects of the ALP system, FIGS. 6*a*, 6*b* and 6*c* present an example of ALP equalization from a white noise music file.

FIG. 6*a* represents the loudspeaker frequency response for a sample of a white noise music file. It is noted that the loudspeaker have a resonant frequency at about 400 Hz.

In order to control the response module, an ALP system is installed in the DSP 103 and its compensation module (shown in FIG. 6*b*) presents an absorption between 150 Hz and 700 Hz with a maximum at 400 Hz.

When the ALP system is active, the equalized frequency response module of the loudspeaker is the multiplication between the loudspeaker response module (FIG. 6*a*) and the ALP response module (FIG. 6*b*). The equalized response module is presented in FIG. 6*c*.

It is to be noted that no resonant frequency is visible on the equalized response module and thus, the membrane displacement is controlled: no mechanical resonance can occur.

Figure 7A:
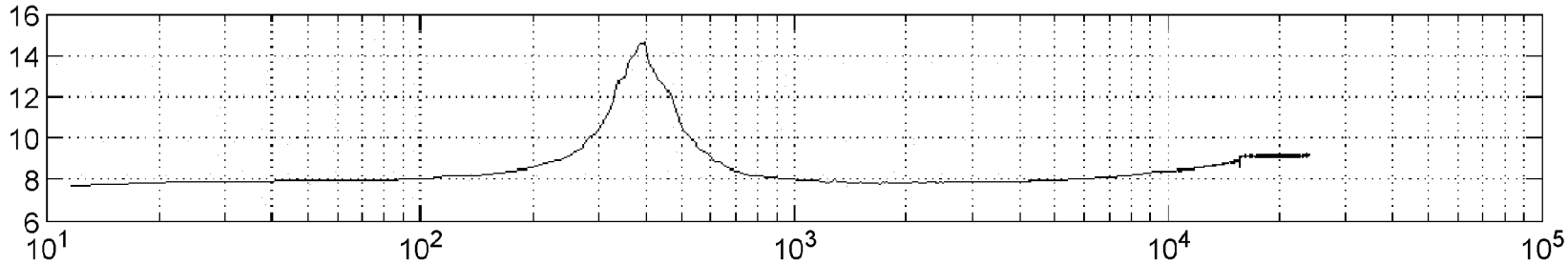
FIGS. 7*a*, 7*b* and 7*c* present respectively the module of a possible frequency response of a loudspeaker when solicited with a jazz audio stream, the module of the corresponding compensation filter and the module of the loudspeaker when solicited with the jazz audio stream filtered with the compensation filter.
Figure 7B:
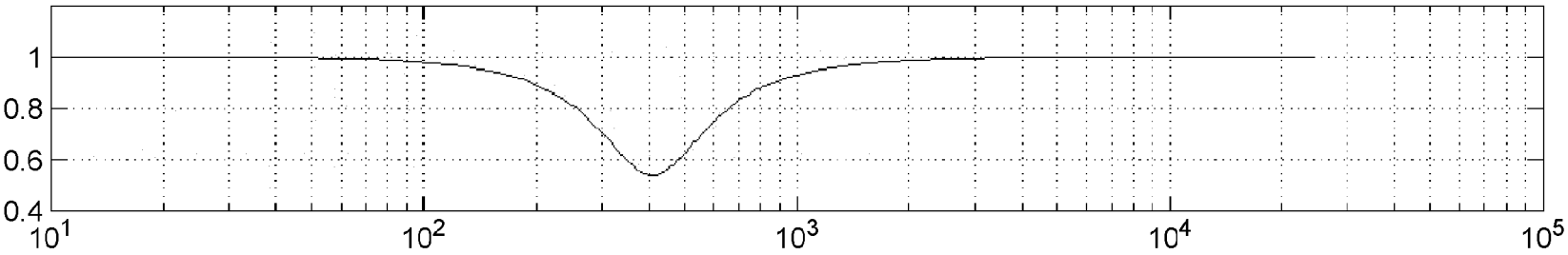
Figure 7C:
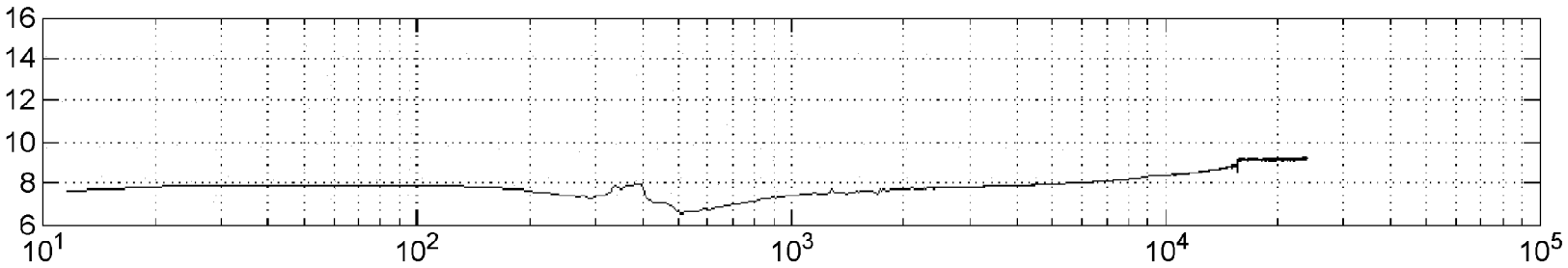

FIGS. 7*a*, 7*b* and 7*c* are similar to the FIGS. 6*a*, 6*b* and 6*c* but present instead an example of ALP equalization from a jazz music file. This example is quite representative of a real situation.

It is to be noted that no resonant frequency is visible in FIG. 7*c*. The response module is quite flat on barely all audible frequencies.

Figure 8:
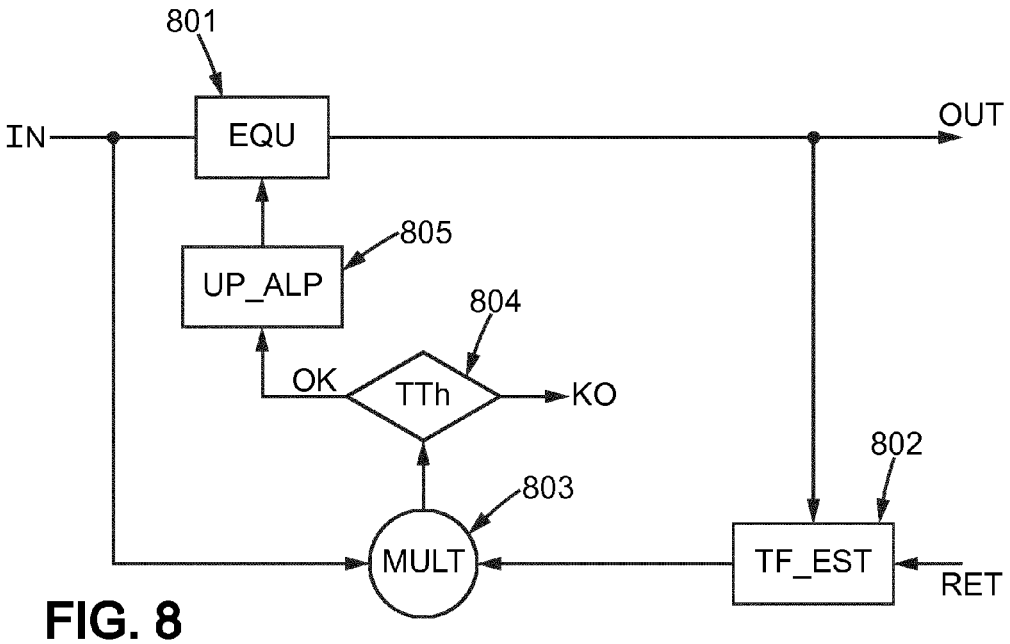
FIG. 8 is an example of a flow chart illustrating steps of a process to filter dynamically an audio stream.

FIG. 8 is an example of a flow chart illustrating steps of a process to implement an adaptive loudspeakers protection.

This flow chart can represent steps of an example of a computer program which may be executed by the DSP 103.

Upon reception of a part of an audio file (arrow IN), the audio stream extracted from this part is filtered with a given "ALP filter" (step 801). This "ALP filter" is updated regularly by a process described below. At the initialization of the DSP, the "ALP filter" can be a filter which does not modify the input stream (i.e. $H_m(s)=1$) or can be a pre-computed filter computed once for all in the factory.

Then, the DSP 103 transmits the filtered audio stream to the DAC 105 in order to be rendered on the loudspeaker 108 (arrow OUT).

Upon reception of information about consumed current in the loudspeaker (arrow RET), the DSP 103 computes (step 802) the estimated transfer function of the loudspeaker thanks to this information and the filtered audio stream. This computation is for instance described above when describing the computation of LS(f) and $LS_m(s)$ Thus, the DSP 103 filters (step 803) the input audio stream (before equalization) with the estimated transfer function.

If (step 804) the result of the multiplication is higher than a given threshold, the given "ALP filter" is updated by computing a new "ALP filter" from the estimated transfer function (step 805) as described above (see description of FIG. 1).

This threshold value can be fixed for a given type of loudspeaker and has not to be changed from one loudspeaker sample to another. It can be fixed before production on loudspeakers during the tuning procedure.

Consecutively, the ALP filter is regularly and dynamically updated in regard of the current transfer function of the loudspeaker. The "ALP filter" compensates the resonances of the loudspeaker and modifications of the characteristics of this resonance (frequency, amplitude) are dynamically taken in account.

While there has been illustrated and described what are presently considered to be the preferred embodiments of the present invention, it will be understood by those skilled in the art that various other modifications may be made, and equivalents may be substituted, without departing from the true scope of the present invention. Additionally, many modifications may be made to adapt a particular situation to the teachings of the present invention without departing from the central inventive concept described herein. Furthermore, an embodiment of the present invention may not include all of the features described above. Therefore, it is intended that the present invention not be limited to the particular embodiments disclosed, but that the invention include all embodiments falling within the scope of the invention as broadly defined above.

Expressions such as "comprise", "include", "incorporate", "contain", "is" and "have" are to be construed in a non-exclusive manner when interpreting the description and its associated claims, namely construed to allow for other items or components which are not explicitly defined also to be present. Reference to the singular is also to be construed in be a reference to the plural and vice versa.

A person skilled in the art will readily appreciate that various parameters disclosed in the description may be modified and that various embodiments disclosed may be combined without departing from the scope of the invention.

The invention claimed is:

1. A method of protecting an inductive loudspeaker arranged to consume a current of a given value during reproduction of an audio stream, the method comprising:

filtering a first part of the audio stream by applying a compensation filter to the first part of the audio stream;

inputting the filtered first part of the audio stream to the inductive loudspeaker;

sensing, via an electronic circuit coupled to the inductive loudspeaker through a current mirror circuit, a value of the current consumed by the inductive loudspeaker during reproduction of the filtered first part of the audio stream;

computing at least a first estimation of a frequency response of the inductive loudspeaker based at least on:

the filtered first part of the audio stream; and the value of the current consumed by the inductive loudspeaker during reproduction of the filtered first part of the audio stream; and updating characteristics of the compensation filter so as to attenuate a resonant frequency in the first estimated frequency response of the inductive loudspeaker.

2. The method of claim 1 wherein the updated characteristics of the compensation filter define a band-stop filter adapted to attenuate the resonant frequency in the first estimated frequency response of the inductive loudspeaker.

3. The method of claim 1 further comprising:

filtering a second part of the audio stream by applying the compensation filter to the second part of the audio stream;

inputting the filtered second part of the audio stream to the inductive loudspeaker;

computing at least a second estimation of a frequency response of the inductive loudspeaker based at least on:

the filtered second part of the audio stream; and the value of the current consumed by the inductive loudspeaker during reproduction of the filtered second part of the audio stream; and updating the characteristics of the compensation filter so as to attenuate a resonant frequency in the second estimated frequency response of the inductive loudspeaker.

4. The method of claim 3 further comprising updating the characteristics of the compensation filter only if the second estimated response of the loudspeaker is lower than a threshold, the second estimated response being computed by applying the first estimation of a frequency response of the inductive loudspeaker to a third part of the audio stream.

5. The method of claim 3 further comprising sensing, via the electronic circuit coupled to the inductive loudspeaker through the current mirror circuit, the value of the current consumed by the inductive loudspeaker during reproduction of the filtered second part of the audio stream.

6. A processing device connected with a mixing signal circuit comprising an inductive loudspeaker, comprising:

a first input interface configured to receive a part of an audio stream;

a second input interface configured to receive a value of a current consumed by the inductive loudspeaker;

an output interface configured to send a filtered part of an audio stream;

the processing device configured to:

filter a first part of the audio stream by applying a compensation filter to the first part of the audio stream;

input the filtered first part of the audio stream to the inductive loudspeaker;

sense, via an electronic circuit coupled to the inductive loudspeaker through a current mirror circuit, the value of the current consumed by the inductive loudspeaker during reproduction of the filtered first part of the audio stream;

compute at least a first estimation of a frequency response of the inductive loudspeaker based at least on:

the filtered first part of the audio stream; and the value of the current consumed (RET) by the inductive loudspeaker during reproduction of the filtered first part of the audio stream; and update characteristics of the compensation filter so as to attenuate a resonant frequency in the first estimated frequency response of the inductive loudspeaker.

7. The processing device of claim 6 wherein the processing device is further configured to update the characteristics of the compensation filter based upon a second compensation filter, the updated characteristics of the compensation filter defining a band-stop filter configured to attenuate the resonant frequency in the first estimated frequency response of the inductive loudspeaker.

8. The processing device of claim 6 wherein the processing device is further configured to:

filter a second part of the audio stream by applying the compensation filter to the second part of the audio stream;

input the filtered second part of the audio stream to the inductive loudspeaker;

compute at least a second estimation of a frequency response of the inductive loudspeaker based at least on:

the filtered second part of the audio stream; and the value of the current consumed by the inductive loudspeaker during reproduction of the filtered second part of the audio stream; and update characteristics of the compensation filter so as to attenuate a resonant frequency in the second estimated frequency response of the inductive loudspeaker.

9. The processing device of claim 6 wherein the processing device is further configured to update the characteristics of the compensation filter only if a second estimated response of the loudspeaker is lower than a threshold, the second estimated response being computed by applying the first estimation of a frequency response of the inductive loudspeaker to a third part of the audio stream.

10. An electronic device comprising:

a mixing signal circuit comprising an inductive loudspeaker comprising:

a first input interface configured to receive a part of an audio stream;

a second input interface configured to receive a value of a current consumed by the inductive loudspeaker;

an output interface configured to send a filtered part of an audio stream; and a processing device operatively connected to the mixing signal circuit and configured to:

filter a first part of the audio stream by applying a compensation filter to the first part of the audio stream;

input the filtered first part of the audio stream to the inductive loudspeaker;

sense, via an electronic circuit coupled to the inductive loudspeaker through a current mirror circuit, the value of the current consumed by the inductive loudspeaker during reproduction of the filtered first part of the audio stream;

compute at least a first estimation of a frequency response of the inductive loudspeaker based at least on:

the filtered first part of the audio stream; and the value of the current consumed by the inductive loudspeaker during reproduction of the filtered first part of the audio stream; and update characteristics of the compensation filter so as to attenuate a resonant frequency in the first estimated frequency response of the inductive loudspeaker.

11. The electronic device of claim 10 wherein the processing device is further configured to update the characteristics of the compensation filter based upon a second compensation filter, the updated characteristics of the compensation filter defining a band-stop filter configured to attenuate the resonant frequency in the first estimated frequency response of the inductive loudspeaker.

12. The electronic device of claim 10 wherein the processing device is further configured to:

filter a second part of the audio stream by applying the compensation filter to the second part of the audio stream;

input the filtered second part of the audio stream to the inductive loudspeaker;

compute at least a second estimation of a frequency response of the inductive loudspeaker based at least on:

the filtered second part of the audio stream; and the value of the current consumed by the inductive loudspeaker during reproduction of the filtered second part of the audio stream; and update characteristics of the compensation filter so as to attenuate a resonant frequency in the second estimated frequency response of the inductive loudspeaker.

13. The electronic device of claim 10 wherein the processing device is further configured to update the characteristics of the compensation filter only if a second estimated response of the loudspeaker is lower than a threshold, the second estimated response being computed by applying the first estimation of a frequency response of the inductive loudspeaker to a third part of the audio stream.

14. A computer program product configured to protect an inductive loudspeaker arranged to consume a current of a given value during reproduction of an audio stream, the computer program product comprising a non-transitory computer readable medium having a computer program stored thereon, the computer program comprising program instructions configured to be loaded into a data-processing circuit that, when executed by the data-processing circuit, configures the data-processing circuit to:

filter a first part of the audio stream by applying a compensation filter to the first part of the audio stream;

input the filtered first part of the audio stream to the inductive loudspeaker;

sense, via an electronic circuit coupled to the inductive loudspeaker through a current mirror circuit, a value of the current consumed by the inductive loudspeaker during reproduction of the filtered first part of the audio stream;

compute at least a first estimation of a frequency response of the inductive loudspeaker based at least on:

the filtered first part of the audio stream; and the value of the current consumed by the inductive loudspeaker during reproduction of the filtered first part of the audio stream; and update characteristics of the compensation filter so as to attenuate a resonant frequency in the first estimated frequency response of the inductive loudspeaker.

15. The computer program product of claim 14 wherein the updated characteristics of the compensation filter define a band-stop filter adapted to attenuate the resonant frequency in the first estimated frequency response of the inductive loudspeaker.

16. The computer program product of claim 14 wherein, when executed by the data-processing circuit, the computer program further configures the data-processing circuit to:

filter a second part of the audio stream by applying the compensation filter to the second part of the audio stream;

input the filtered second part of the audio stream to the inductive loudspeaker;

compute at least a second estimation of a frequency response of the inductive loudspeaker based at least on:

the filtered second part of the audio stream; and the value of the current consumed by the inductive loudspeaker during reproduction of the filtered second part of the audio stream; and update the characteristics of the compensation filter so as to attenuate a resonant frequency in the second estimated frequency response of the inductive loudspeaker.

17. The computer program product of claim 16 wherein, when executed by the data-processing circuit, the computer program further configures the data-processing circuit to update the characteristics of the compensation filter only if the second estimated response of the loudspeaker is lower than a threshold, the second estimated response being computed by applying the first estimation of a frequency response of the inductive loudspeaker to a third part of the audio stream.

18. The computer program product of claim 16 wherein, when executed by the data-processing circuit, the computer program further configures the data-processing circuit to sense the value of the current consumed by the inductive loudspeaker during reproduction of the filtered second part of the audio stream using the electronic circuit coupled to the inductive loudspeaker through the current mirror circuit.

* * * * *